US008458821B2

(12) United States Patent
Rivas, III et al.

(10) Patent No.: US 8,458,821 B2
(45) Date of Patent: Jun. 11, 2013

(54) HELMET STABILIZATION APPARATUS

(75) Inventors: Joe Rivas, III, Chula Vista, CA (US); Timothy Langan, Laguna Hills, CA (US)

(73) Assignee: Shrike Industries, Inc., Mission Viejo, CA (US)

( * ) Notice: Subject to any disclaimer, the term of this patent is extended or adjusted under 35 U.S.C. 154(b) by 766 days.

(21) Appl. No.: 12/333,267

(22) Filed: Dec. 11, 2008

(65) Prior Publication Data

US 2010/0146684 A1 Jun. 17, 2010

(51) Int. Cl.
*A42B 1/24* (2006.01)

(52) U.S. Cl.
USPC ..... 2/422; 2/5; 2/6.6; 294/59; 7/116

(58) Field of Classification Search
USPC ..... 294/59; 7/116; 2/422, 5, 6.6
See application file for complete search history.

(56) References Cited

U.S. PATENT DOCUMENTS

| | | | | |
|---|---|---|---|---|
| 2,848,924 | A | 8/1958 | Potez | |
| 3,308,477 | A | 3/1967 | Boyd | |
| 4,000,520 | A | 1/1977 | Svendsen et al. | |
| 4,028,739 | A | 6/1977 | Bell et al. | |
| 4,276,657 | A | 7/1981 | Montesi | |
| 4,449,787 | A | 5/1984 | Burbo et al. | |
| 4,457,461 | A | 7/1984 | Docking et al. | |
| 4,476,939 | A * | 10/1984 | Wallace | 172/374 |
| 4,697,783 | A | 10/1987 | Kastendieck et al. | |
| 4,700,420 | A * | 10/1987 | Belanger | 7/114 |
| D298,205 | S * | 10/1988 | Pollak | D8/10 |
| 5,079,780 | A | 1/1992 | Coombs et al. | |
| 5,342,411 | A * | 8/1994 | Maxted et al. | 607/107 |
| 5,483,698 | A | 1/1996 | Douglas | |
| 5,658,065 | A * | 8/1997 | Jamieson | 362/106 |
| D390,581 | S | 2/1998 | Palmer | |
| 5,752,298 | A | 5/1998 | Howell | |

(Continued)

FOREIGN PATENT DOCUMENTS

| | | |
|---|---|---|
| WO | WO-2006084223 | 8/2006 |
| WO | WO2006084223 | 8/2006 |
| WO | WO2008050307 | 5/2008 |
| WO | WO-2008050307 | 5/2008 |

OTHER PUBLICATIONS

"Crovel Extreme OD Green", SurvivalOutdoorGear.com, http://www.survivaloutdoorgear.com/product_info.php?products_id=54176372.

*Primary Examiner* — Christopher Harmon
(74) *Attorney, Agent, or Firm* — Fish & Associates, PC

(57) ABSTRACT

The helmet stabilization apparatus includes a helmet adapted to be worn by a user, a night vision goggle unit attached to a front portion of the helmet, and a removable counterweight attached to a rear portion of the helmet that balances with the weight of the night vision goggle unit, wherein said removable counterweight can be connected in a variety of manners, such as a magnetic means of connection, a hook and loop connection, or a mechanical means of connection. Furthermore, the helmet may provide staggered connections, such that the removable counterweight may be positioned on the helmet at the user's desired orientation. This allows the user to move the center of mass of the system such that it is self-stabilizing on the user's head. Moreover, the removable counterweight may be formed such that when it is removed, it may be coupled with an attachable handle to form a plurality of tools or weapons. This is beneficial in that it provides a collection of tools while only one object need be carried.

11 Claims, 9 Drawing Sheets

U.S. PATENT DOCUMENTS 5,996,127 A * 12/1999 Leslie ..... 2/422
6,289,540 B1 * 9/2001 Emonds ..... 7/116
6,357,067 B1 * 3/2002 Jones ..... 7/116
6,374,407 B1 * 4/2002 Howell ..... 2/6.7
6,606,192 B2 * 8/2003 Haran ..... 359/409
7,234,173 B2 6/2007 McCalla
7,841,026 B2 * 11/2010 Makris et al. ..... 2/424
2001/0022686 A1 9/2001 Haran
2006/0097530 A1 * 5/2006 Marquardt et al. ..... 294/57
2007/0022520 A1 2/2007 Grassl et al.
2007/0145756 A1 * 6/2007 DeWinter ..... 294/54.5
2008/0136916 A1 * 6/2008 Wolff ..... 348/169

* cited by examiner

HELMET STABILIZATION APPARATUS

TECHNICAL FIELD OF THE INVENTION

The present invention relates in general to headgear and, more specifically, to a helmet stabilization apparatus that counter balances the frontal load of a night vision goggle unit mounted upon the front of a helmet.

COPYRIGHT & TRADEMARK NOTICE

A portion of the disclosure of this patent application may contain material that is subject to copyright protection. The owner has no objection to the facsimile reproduction by any one of the patent document or the patent disclosure, as it appears in the Patent and Trademark Office patent file or records, but otherwise reserves all copyrights whatsoever.

Certain marks referenced herein may be common law or registered trademarks of third parties affiliated or unaffiliated with the applicant or the assignee. Use of these marks is by way of example and shall not be construed as descriptive or to limit the scope of this invention to material associated only with such marks.

BACKGROUND OF THE INVENTION

Protective helmets are used in a variety of activities, such as in the military and in law enforcement. These helmets often comprise a rigidly formed shell for protection and a support system for supporting the helmet in relation to the user's head. The support system typically comprises straps that extend from the rim of the shell of the helmet to wrap around a portion of the user's head or neck, usually around the chin or the nape of the neck.

For some helmets, different attachments are desired or necessary based on the activity to be performed. One such attachment includes a night vision goggle unit. During activities or operations under darkened conditions, a user may wear the night vision goggle unit to facilitate vision in low levels of light. The night vision goggle unit attaches to the front of the helmet in the region approximate to the location of the user's forehead. Ideally the center of mass for such a system would be directly over the top of a user's head; such that there is no offset to the weight, as an offset weight causes a tendency to rotate that must be counteracted by the user's neck muscles to maintain equilibrium. The night vision goggle unit is quite heavy (often 2 pounds or more), and users may have to wear the system for hours at a time, typically causing neck strain and fatigue. Because the additional weight of the night vision goggle unit may cause the center of mass of the helmet to be shifted forward, causing the helmet to tilt down over the user's face, the shift forces the user to activate neck muscles to prevent the tilt.

Due to the weight of the night vision goggle unit, the support straps of the helmet may often be inadequate to hold the helmet with the attached night vision goggles in place upon a user's head such that the rim of the helmet is parallel to the ground. Furthermore, the center of mass offset typically allows a relatively heavy helmet and night vision goggle attachment to swing about on a user's head with unintentionally high degrees of freedom. This means the helmet may have mobility free of the user, and thus may not remain as securely in place as desired.

Therefore, for the purpose of balancing the weight of the night vision goggle unit such that a helmet may remain stable upon a user's head, current products addressing the issue utilize a counterweight system that uses mechanical means of attachment to the back of a helmet, such that the counterweight hangs from the bottom rim of the helmet based on the geometry of the counterweight. Current products lack adjustability of the placement of a counterweight, such that the product is not capable of accommodating various preferences or parameters of different users. Moreover, current products must be removed to maintain balance if the night vision goggle unit is removed, leaving the necessity to store the current product when not in use. Contributing to this problem, military and law enforcement personnel typically carry heavy and cumbersome equipment, such that there is a strong benefit associated with multi-purpose equipment capable of various tasks.

Thus a need exists for a counterweight system that will move the center of mass of a helmet with front-loaded attachments to an ideal position, acting through the center of the user's neck, and thus preventing the tilt caused by the weight of the night vision goggles. This change of the effective locus of the center of mass reduces or removes any neck strain of the user that is required to hold the helmet in place, as the helmet may then balance evenly upon the user's head without exertion by the user. There is also a need for a counterweight system that is adjustable for different users depending upon their physical specifications and preferences. Furthermore, it is desired that the design limit unintentional degrees of freedom of the helmet, while not restricting head movement of the user. It is to these ends that the present invention has been developed.

SUMMARY OF THE INVENTION

To minimize the limitations in the prior art, and to minimize other limitations that will be apparent upon reading and understanding the present specification, the present invention describes a helmet stabilization apparatus that counterbalances the frontal load of a night vision goggle unit and restores the center of balance of the helmet stabilization apparatus upon a user's head.

An apparatus in accordance with the present invention may comprise a helmet adapted to be worn by a user, a night vision goggle unit attached to a front portion of the helmet, and a removable counterweight attached to a rear portion of the helmet, wherein said removable counterweight includes one or more connecting ports for secure attachment to a handle, such that said counterweight and said handle attachment may form a tool or weapon. The counterweight may be shaped such that it may form a shovel, axe, awl, pry, or pick.

Additionally, an apparatus in accordance with the present invention may comprise a helmet adapted to be worn by a user, a night vision goggle unit attached to a front portion of the helmet, and a removable counterweight adapted to be attached to different positions along a rear portion of the helmet.

Moreover, an apparatus in accordance with the present invention may comprise a helmet adapted to be worn by a user, a night vision goggle unit attached to a front portion of the helmet, and a removable counterweight attached to a rear portion of the helmet, wherein said removable counterweight is attached via magnetic force.

Furthermore, an apparatus in accordance with the present invention may comprise a helmet adapted to be worn by a user, a night vision goggle unit attached to a front portion of the helmet, and a removable counterweight attached to a rear portion of the helmet.

It is an objective of the present invention to provide a means to counterbalance the front load of a night vision goggle unit attached to a helmet. A further objective of the present invention is to provide the ability to remove the night goggle vision unit without having to remove the counterweight (as it may be moved on the helmet so as to no longer act at an offset from the central axis of the user).

It is another objective of the present invention to provide a counterweight that may be adjusted to the specifications and preferences of a user. Moreover, it is an objective of the present invention that unintentional degrees of freedom of the helmet and night vision goggle system will be reduced while not restricting the user's freedom of movement.

It is yet another objective of the present invention to provide a counterweight which may be attached and detached from a user's helmet.

Finally, it is yet another objective of the present invention to provide a counterweight which may be connected to a handle such that it may function as a tool or weapon. This provides a further benefit in the existence of a multi-functional tool encapsulated in one object's design.

These and other advantages and features of the present invention are described herein with specificity so as to make the present invention understandable to one of ordinary skill in the art.

BRIEF DESCRIPTION OF THE DRAWINGS

Elements in the figures have not necessarily been drawn to scale in order to enhance their clarity and improve understanding of these various elements and embodiments of the invention. Furthermore, elements that are known to be common and well understood to those in the industry are not depicted in order to provide a clear view of the various embodiments of the invention.

FIG. 1(*b*) illustrates a rear view of an exemplary embodiment of a helmet stabilization apparatus with a removable counterweight coupled in a first position via a hook and loop connection interface.

FIG. 1(*c*) illustrates a rear view of an exemplary embodiment of a helmet stabilization apparatus with a removable counterweight coupled in a second position via a hook and loop connection interface.

FIG. 4(*b*) illustrates a rear view of an alternative embodiment of a removable counterweight coupled to a helmet stabilization apparatus wherein said removable counterweight may form a tool or weapon.

FIG. 4(*c*) illustrates a front view of an exemplary embodiment of a removable counterweight with an attachable handle.

FIG. 4(*d*) illustrates a front view of an exemplary embodiment of a tool or weapon comprised of a removable counterweight coupled to attachable handle via an apical attachment port.

DETAILED DESCRIPTION OF THE DRAWINGS

In the following discussion that addresses a number of embodiments and applications of the present invention, reference is made to the accompanying drawings that form a part hereof, where depictions are made, by way of illustration, of specific embodiments in which the invention may be practiced. It is to be understood that other embodiments may be utilized and changes may be made without departing from the scope of the present invention.

Figure 1A:
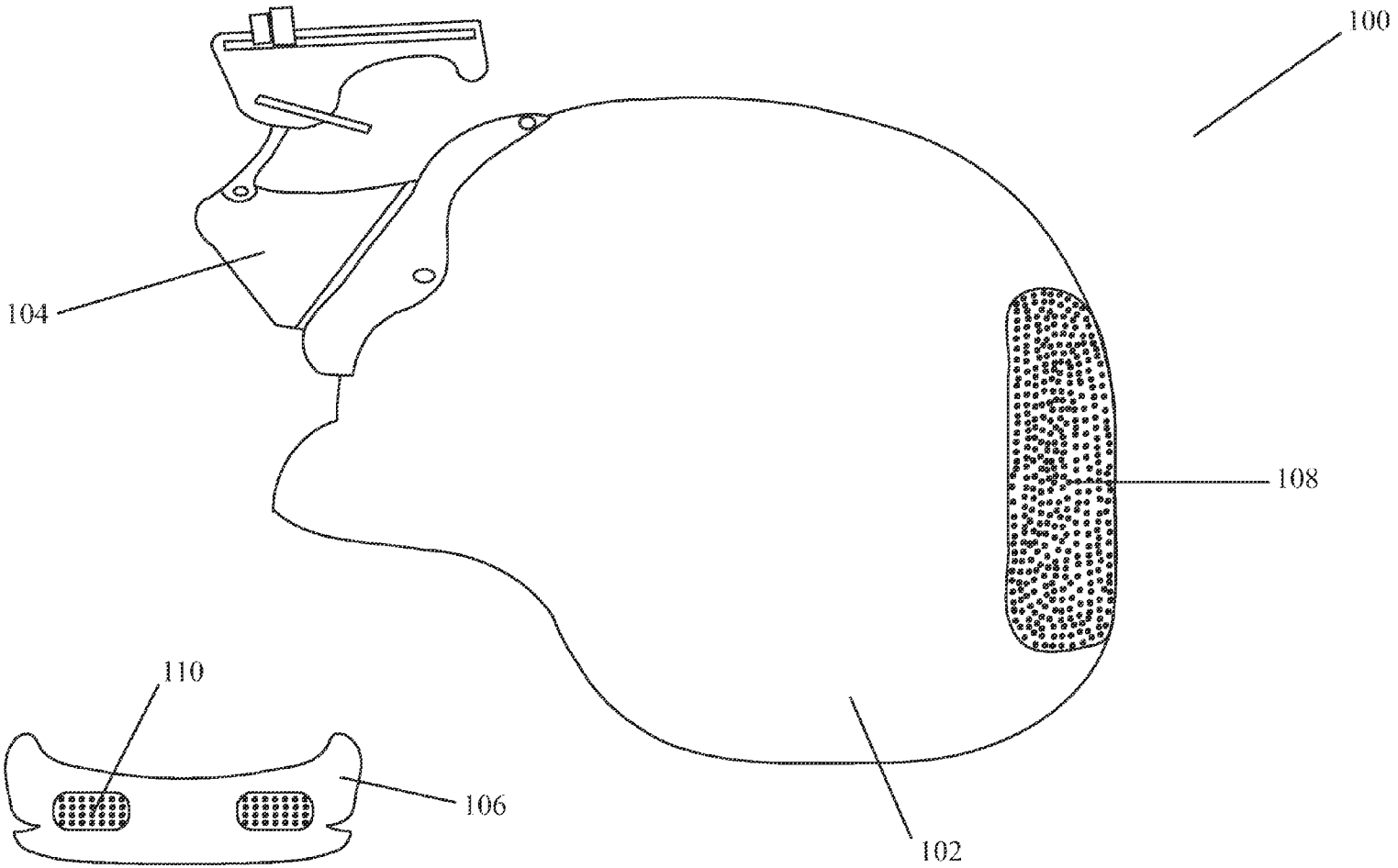
FIG. 1(*a*) illustrates a side view of an exemplary embodiment of a helmet stabilization apparatus wherein a removable counterweight may be attached via a hook and loop connection interface.
Figure 1B:
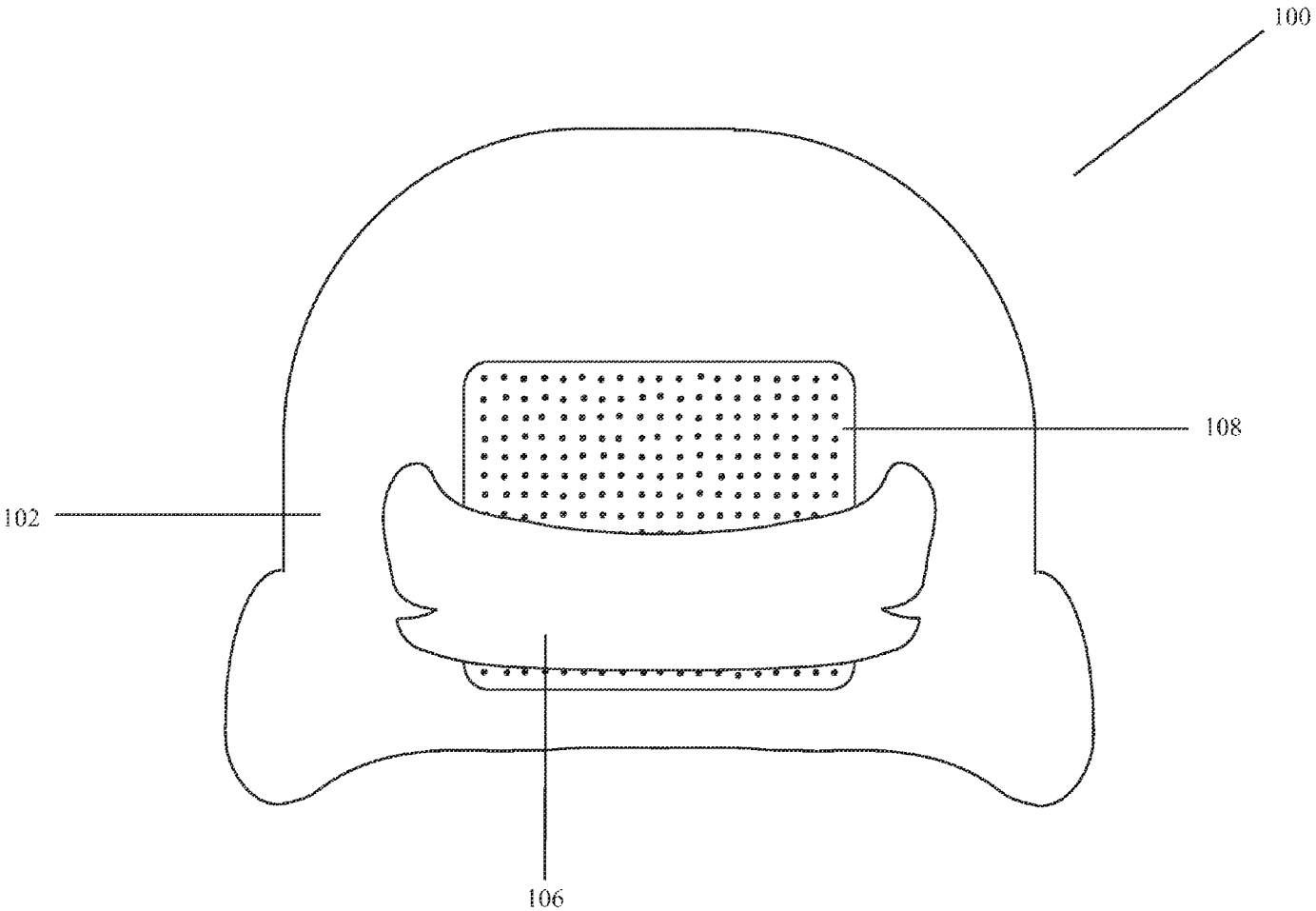
Figure 1C:
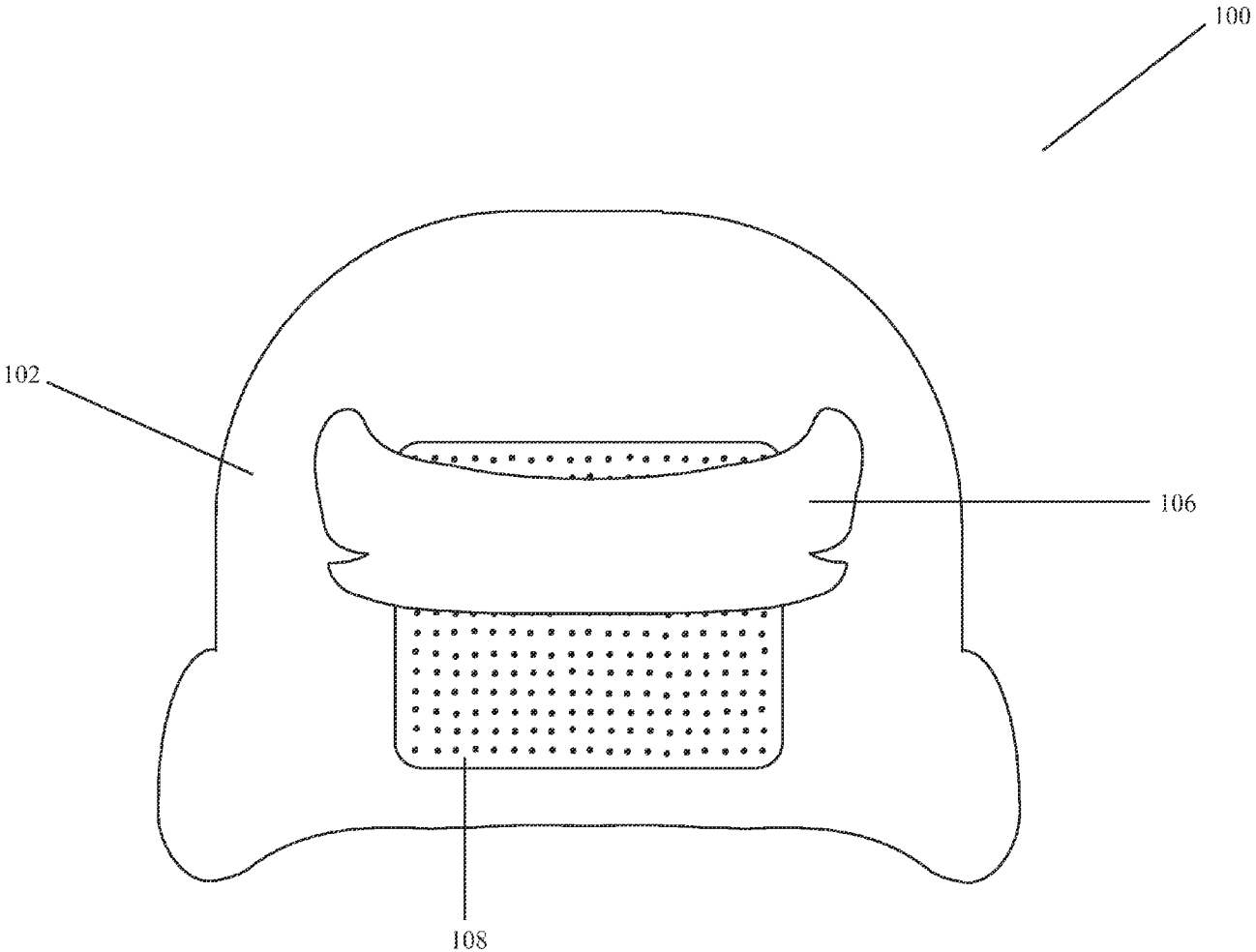

FIG. 1(*a*) illustrates a side view of an exemplary embodiment of a helmet stabilization apparatus wherein a removable counterweight may be attached via a hook and loop connection interface. FIG. 1(*a*) shows helmet stabilization apparatus 100, which contains helmet 102, night vision goggle unit 104, removable counterweight 106, hook and loop connection interface 108, and hook and loop connectors 110. Helmet stabilization apparatus 100 is designed to maintain the functionality of helmet 102 in conjunction with night vision goggle unit 104, but to also counterbalance the frontal load of night vision goggle unit 104 upon helmet 102, and may restore the center of balance of helmet stabilization apparatus 100 upon a user's head as if there were no offset load, and the system was at equilibrium.

Helmet 102 is a form of protective covering that may be worn on the head of a user. Helmet 102 may also couple to night vision goggle unit 104 and interface with removable counterweight 106. Helmet 102 may be composed of a variety of materials, such as metal, plastic, or leather. In an exemplary embodiment, helmet 102 may be composed of a strong material, such as aramid synthetic fibers, commonly referred to as Kevlar™, such that helmet 102 may provide ballistic and impact protection should helmet 102 be worn in combat situations. Additionally, helmet 102 may be modified such that removable counterweight 106 may be attachable to and detachable from helmet 102. In the embodiment illustrated in FIG. 1(*a*), helmet 102 contains hook and loop connection interface 108 such that removable counterweight 106 may be attached and detached to helmet 102, thereby allowing a user to adapt helmet 102 so as to add or remove accessories while still maintaining helmet 102's center of mass upon the central axis of the user.

Night vision goggle unit 104 may be any device or system that enables a user to see in environments with relatively low levels of light. In an exemplary embodiment, night vision goggle unit 104 may be mounted with brackets or some other like method along the top and front portion of helmet 102, such that a user may utilize night vision goggle unit 104 hands-free. Because night vision goggle unit 104 is typically attached at a position on helmet 102 that is close to a user's face (allowing for convenient access by user to night vision goggle unit 104), the weight of night vision goggle unit 104 moves the effective locus of the center of mass of the system of helmet 102 and night vision goggle unit 104 from a position centered upon a user's head to an offset position away from the central axis of the user. For example, should a user not require night vision goggle unit 104, if the user were to disconnect night vision goggle unit 104 from helmet 102, the user then would not need to attach removable counterweight 106 to helmet 102 because the weight of helmet 102 would be centered upon the user's head. However, should night vision goggle unit 104 be attached to helmet 102, a user may attach removable counterweight 106 to helmet 102, thereby counterbalancing the weight of night vision goggle unit 104 and centering the weight of helmet stabilization apparatus 100 upon the central axis of the user.

Removable counterweight 106 may counterbalance the weight of night vision goggle unit 104. In the present embodiment, removable counterweight 106 may be attached to or removed from helmet 102 via hook and loop connection interface 108 and hook and loop connectors 110. In a preferred embodiment, removable counterweight 106 may be composed of the same preferred material as that of helmet 102, such that removable counterweight 106 may provide ballistic and impact protection. Additionally, removable counterweight 106 may be tailored so as to have the same, or comparable, weight as that of night vision goggle unit 104 so as to effectively counterbalance the weight of night vision goggle unit 104 when placed in an appropriately counterbalanced position. However, the size, weight or shape of removable counterweight 106 should not be interpreted so as to limit the scope of the present invention.

Hook and loop connection interface 108 may couple helmet 102 to removable counterweight 106 via hook and loop connectors 110. Hook and loop connection interface 108 and hook and loop connectors 110 may be composed of hook and loop fasteners. Hook and loop connection interface 108 and hook and loop connectors 110 may each consist of a hook layer and a loop layer, respectively. In one embodiment, hook and loop connection interface 108 may consist of a surface comprised of a series of small hooks, while hook and loop connectors 110 may comprise of a series of small loops. However, in another embodiment, hook and loop connection interface 108 may consist of a surface comprised of a series of small loops, while hook and loop connectors 110 may comprise a series of small hooks.

Hook and loop connection interface 108 may be securely attached to helmet 102. In an exemplary embodiment, hook and loop connection interface 108 may be coupled to helmet 102 by a strong adhesive. In other embodiments, however, hook and loop connection interface 108 may be coupled to helmet 102 by other methods, such as mounting brackets or stitching. Therefore, the means of connection between hook and loop connection interface 108 and helmet 102 should not be interpreted so as to narrow the scope of the present invention.

Hook and loop connectors 110 may be securely attached to the posterior surface of removable counterweight 106. In an exemplary embodiment, hook and loop connectors 110 may be coupled to removable counterweight 106 by a strong adhesive. In other embodiments, however, hook and loop connectors 110 may be coupled to removable counterweight 106 by other methods, such as mounting brackets or stitching.

In the exemplary embodiment illustrated in FIG. 1(*a*), removable counterweight 106 may contain two hook and loop connectors 110. In other embodiments, hook and loop connectors 110 may be so large as to cover the entire posterior surface of removable counterweight 106, or as small as permissible in order to securely attach removable counterweight 106 to helmet 102. Therefore, the means of connection between hook and loop connectors 110 and removable counterweight 106 should not be interpreted so as to narrow the scope of the present invention.

FIG. 1(*b*) illustrates a rear view of an exemplary embodiment of helmet stabilization apparatus 100 with removable counterweight 106 coupled into a first position via hook and loop connection interface 108. FIG. 1(*c*) illustrates a rear view of an exemplary embodiment of helmet stabilization apparatus 100 with removable counterweight 106 coupled in a second position via hook and loop connection interface 108. Helmet stabilization apparatus 100 may allow the user to specifically modify the position of removable counterweight 106 upon helmet 102 in order to maintain helmet 102's center of mass upon the central axis of the user.

As shown in FIGS. 1(*b*) and 1(*c*), the position of removable counterweight 106 upon helmet 102 may be specifically modified by the user via hook and loop connection interface 108 and hook and loop connectors 110. Depending upon the shape, placement, and weight of night vision goggle unit 104, and the size and shape of a user's head, removable counterweight 106 may be placed higher or lower upon hook and loop connection interface 108. The differential placement of removable counterweight 106 allows for the user to maintain helmet 102's center of mass upon the central axis of the user.

Figure 2:
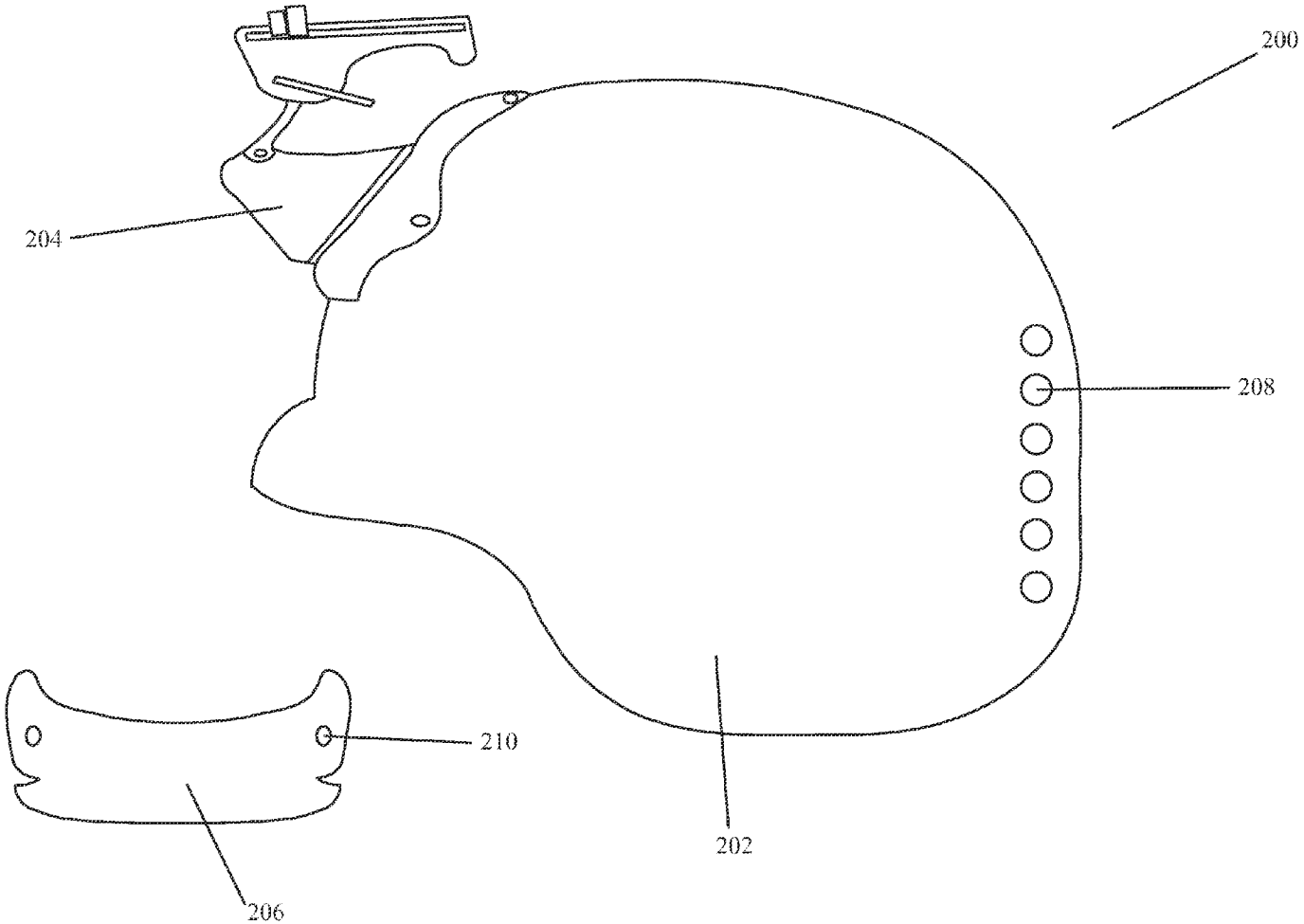
FIG. 2 illustrates a side view of an exemplary embodiment of a helmet stabilization apparatus wherein a removable counterweight may be attached via a mechanical means of connection.

While FIG. 1 illustrates an embodiment of the present invention involving a means of connection utilizing hook and loop fasteners, FIG. 2 illustrates a side view of an exemplary embodiment of a helmet stabilization apparatus wherein a removable counterweight may be attached via mechanical means of connection. FIG. 2 shows helmet stabilization apparatus 200, which contains helmet 202, night vision goggle unit 204, removable counterweight 206, mechanical receiver 208, and mechanical connector 210. Thus, the method of connection between helmet 202 and removable counterweight 206 should not be interpreted so as to limit the scope of the present invention.

Mechanical receiver 208 may couple helmet 202 to removable counterweight 206 via mechanical connector 210. In an exemplary embodiment, mechanical connector 210 (which may be located upon removable counterweight 206), may couple to mechanical receiver 208, thereby attaching removable counterweight 206 to helmet 202. In an exemplary embodiment, mechanical connector 210 may slide or fasten into mechanical receiver 208. For example, mechanical connector 210 may comprise a protruding support member and mechanical receiver 208 may comprise a matching receiver. In another exemplary embodiment, mechanical connector 210 may connect to mechanical receiver 208 via a spring loaded bolt and bracket assembly. However, in other embodiments, connection between mechanical receiver 208 and mechanical connector 210 may be accomplished by other methods, such as interlocking discs, knots or buttons. This list of connections is not exhaustive, however, and should not be interpreted so as to narrow the scope of the present invention.

Additionally, mechanical receivers 208 may be placed in staggered positions upon the rear face of helmet 202. In an exemplary embodiment of helmet stabilization apparatus 200, mechanical receivers 208 may be placed at incremental distances apart, thereby allowing a user to place removable counterweight 206 at a position upon helmet 202 that adequately counterbalances the weight of night vision goggle unit 204. In a exemplary embodiment of helmet stabilization apparatus 200, mechanical receivers 208 may be placed in two columns upon helmet 202, with the mechanical receivers 208 in each column incrementally spaced, and the two columns separated by a constant distance that is matched by the distance between two mechanical connectors 210 coupled to removable counterweight 206.

Figure 3:
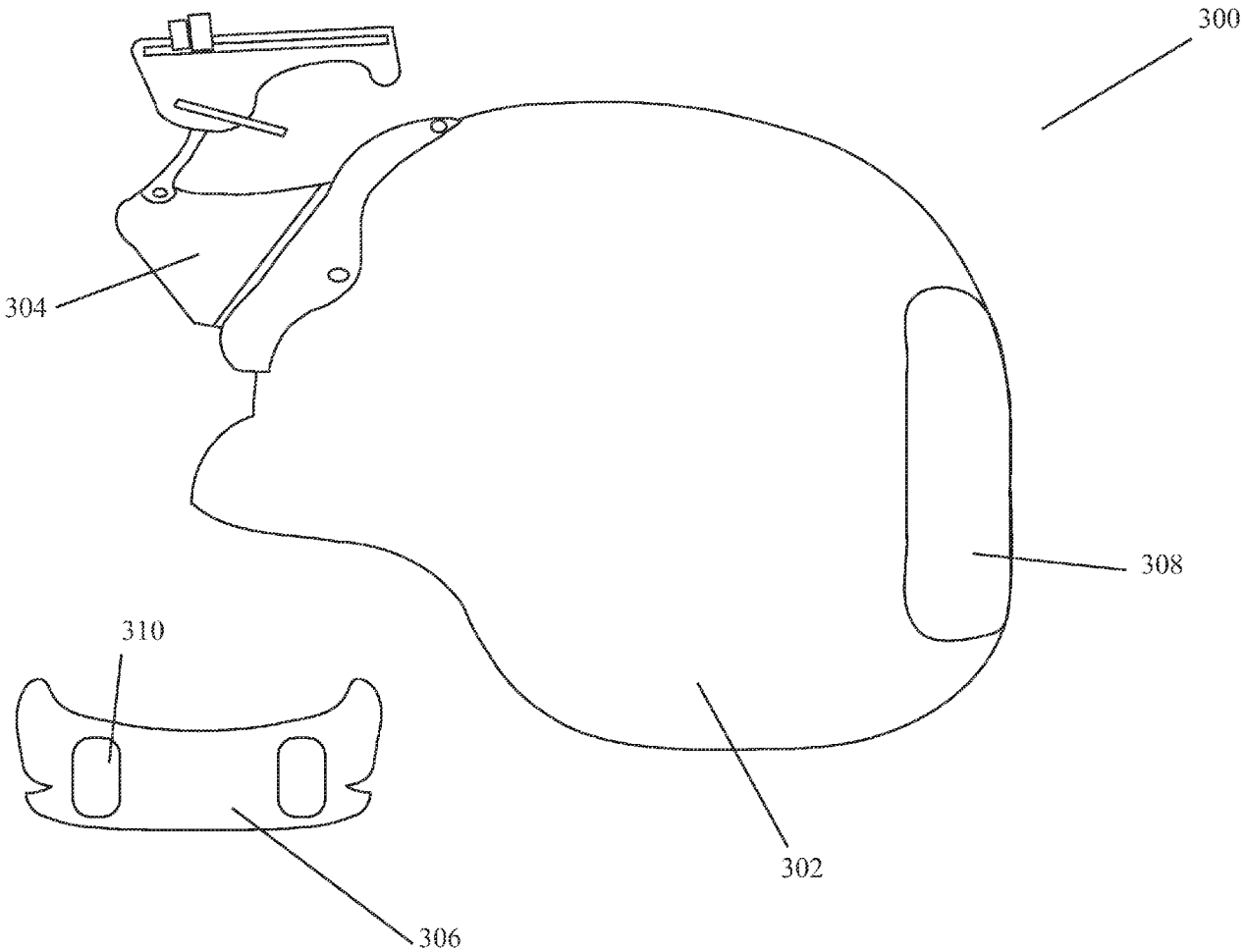
FIG. 3 illustrates a side view of an exemplary embodiment of a helmet stabilization apparatus wherein a removable counterweight may be attached via magnetic force.
Figure 4A:
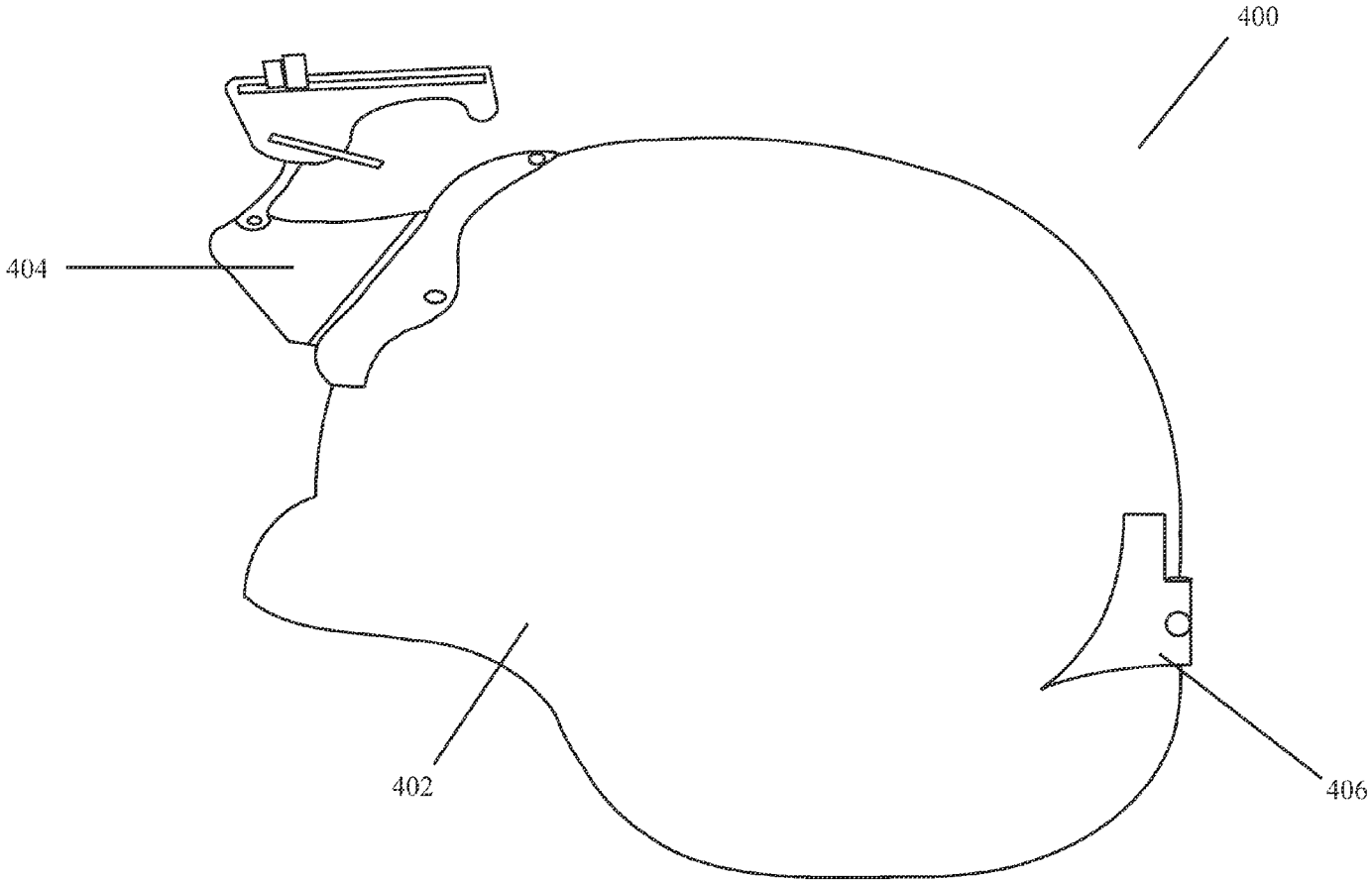
FIG. 4(*a*) illustrates a side view of an exemplary embodiment of a helmet stabilization apparatus with a removable counterweight that may form a tool or weapon.
Figure 4B:
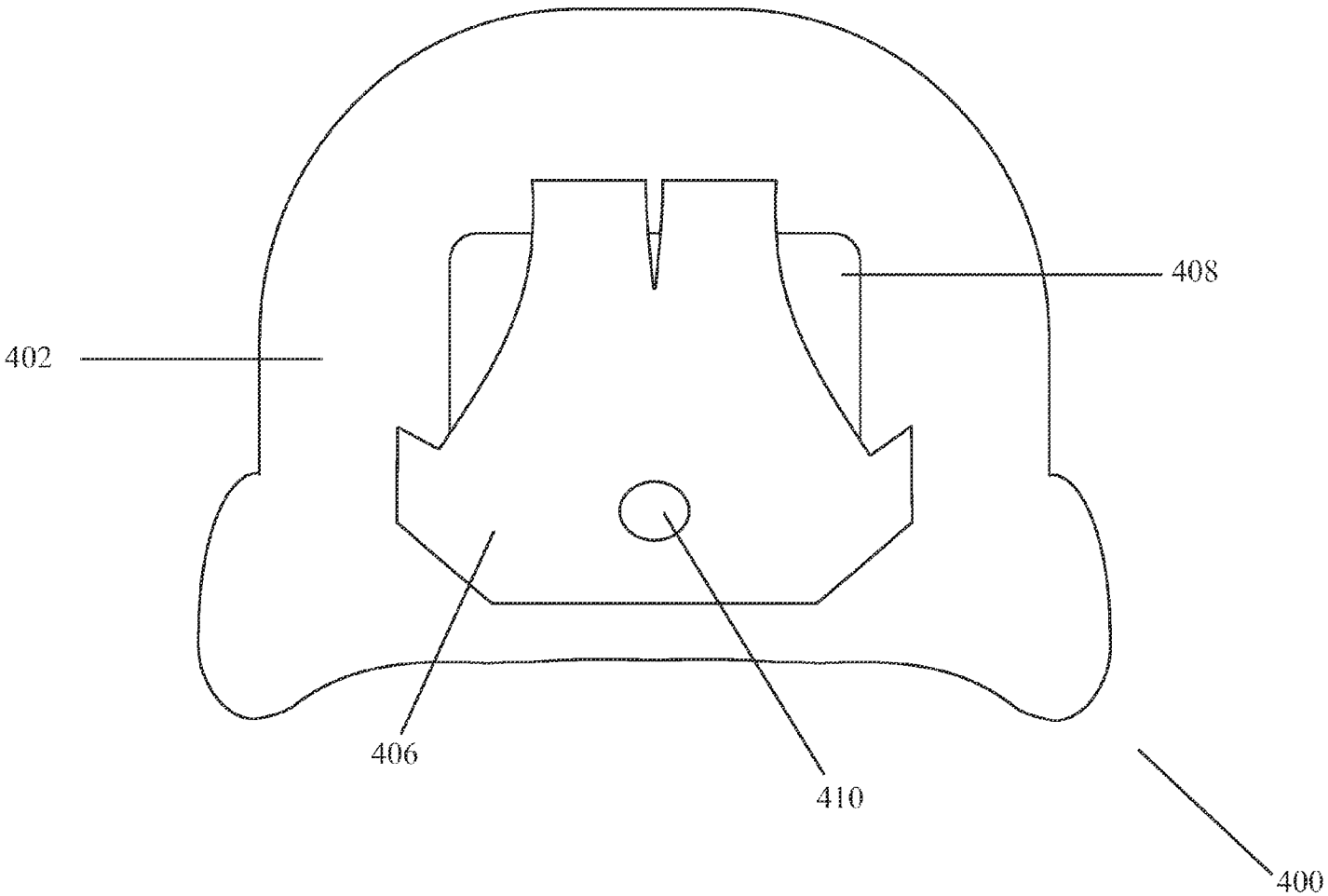
Figure 4C:
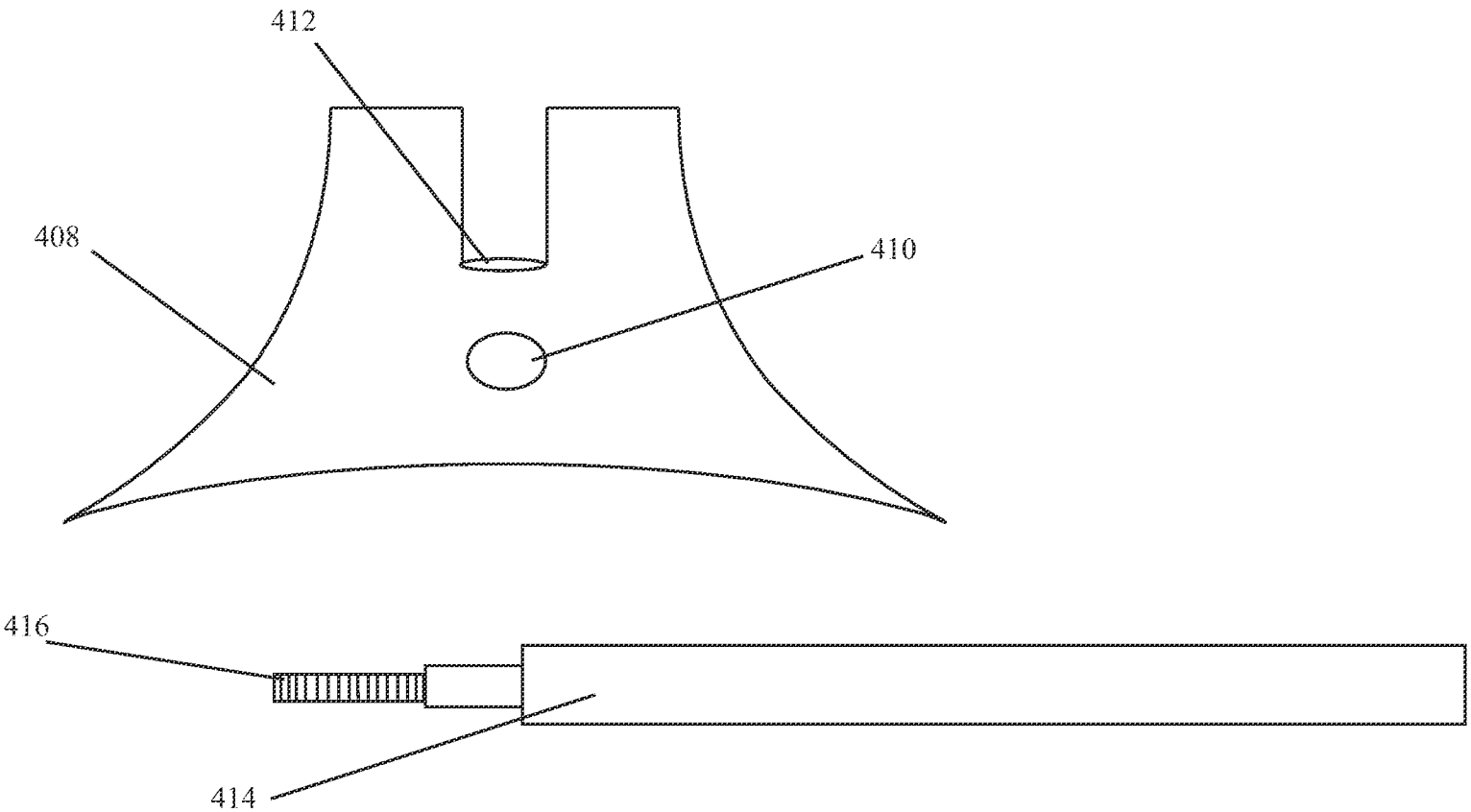
Figure 4D:
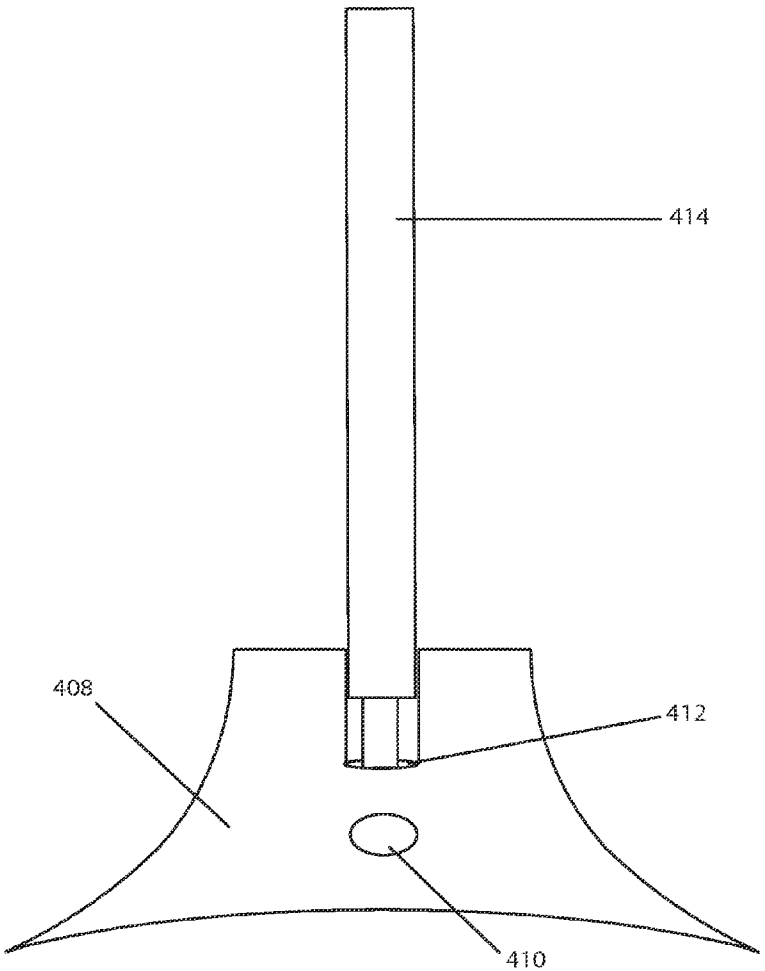

FIG. 3 illustrates a side view of an exemplary embodiment of a helmet stabilization apparatus wherein a removable counterweight may be attached via magnetic force. FIG. 3 shows helmet stabilization apparatus 300, which contains helmet 302, night vision goggle unit 304, removable counterweight 306, magnetic interface 308, and magnetic connector 310.

Magnetic interface 308 may couple helmet 302 to removable counterweight 306 via magnetic connector 310. In an exemplary embodiment, magnetic connectors 310 (which may be located on removable counterweight 306), may be comprised of materials that are magnetic, such that, in conjunction with magnetic interface 308, magnetic connectors 310 securely couple removable counterweight 306 to helmet 302. Additionally, due to the physical properties of magnets, the polarity of magnetic interface 308 must be opposite that of the polarity of magnetic connector 310.

In another embodiment, removable counterweight 306 may be entirely magnetic. Should removable counterweight 306 be entirely magnetic, removable counterweight 306 may directly couple to magnetic interface 308 on helmet 302 via magnetic force.

To couple removable counterweight 306 to helmet 302, a user would simply need to place removable counterweight 306 onto magnetic interface 308, located on the rear face of helmet 302. Should a user desire to adjust the placement of removable counterweight 306, the user may simply slide removable counterweight 306 upon magnetic interface 308.

FIG. 4(*a*) illustrates a side view of an exemplary embodiment of a helmet stabilization apparatus with a removable counterweight that may form a tool or weapon. FIG. 4(*b*) illustrates a rear view of an alternative embodiment of a removable counterweight coupled to a helmet stabilization apparatus wherein said removable counterweight may form a tool or weapon. FIGS. 4(*a*) and 4(*b*) show helmet stabilization apparatus 400, which contain helmet 402, night vision goggle unit 404, removable counterweight 406, removable counterweight attachment site 408, facial attachment port 410, and apical attachment port 412.

Removable counterweight 406 may attach to the back of helmet 402 via removable counterweight attachment site 408. It should be noted that alternative embodiments of helmet stabilization apparatus 400 may utilize different means of connection between removable counterweight 406 and helmet 402, such as those previously described.

FIG. 4(*c*) illustrates a front view of an exemplary embodiment of a removable counterweight and attachable handle. FIG. 4(*d*) illustrates a front view of an exemplary embodiment of a tool or weapon comprised of a removable counterweight coupled to attachable handle via an apical attachment port. FIGS. 4(*c*) and 4(*d*) show removable counterweight 406, facial attachment port 410, apical attachment port 412, attachable handle 414, and threaded connector 416.

Facial attachment port 410 may comprise a threaded means of connection for removable counterweight 406 to attachable handle 414. Facial attachment port 410 may be located on either the obverse or reverse face of removable counterweight 406. In an exemplary embodiment, facial attachment port 410 may couple with attachable handle 414 via threaded connector 416, which is located on the distal end of attachable handle 414. In an alternative embodiment, however, facial attachment port 410 may couple with attachable handle 414 via an alternative means of connection, such as mechanical parts or magnetic forces.

Apical attachment port 412 may comprise an alternative means of connection for removable counterweight 406 to attachable handle 414. Apical attachment port 410 may be located at the apex of removable counterweight 406. In an exemplary embodiment, apical attachment port 412 may couple with attachable handle 414 via threaded connector 416, which is located on the distal end of attachable handle 414. In an alternative embodiment, however, apical attachment port 412 may couple with attachable handle 414 via an alternative means of connection, such as mechanical parts or magnetic forces.

Additionally, apical attachment port 412 may be used in conjunction with varying weights of bolts (not shown) in order to counteract the weight of night vision goggle unit 404. For example, varying bolt weights may be a half pound, 1 pound or 2 pounds so that when attached to apical attachment port 412 it increases the weight of removable counterweight 406. Thus, a bolt of a certain weight and comparable material could be inserted into apical attachment port 412 in order to provide the user with the option of adjusting the weight of removable counterweight 406 should such be desirable when using this embodiment.

Attachable handle 414 may comprise a handle that, when coupled to removable counterweight 406, may form a tool or weapon. Attachable handle may be composed of a variety of materials, such as wood, metal, or plastic. In an exemplary embodiment, attachable handle 414 may be shaped such that it is not cumbersome or a burden should a user carry or store attachable handle 414.

Should a user detach removable counterweight 406 from helmet 402, the user may couple attachable handle 414 with removable counterweight 406 so as to form a tool or weapon. Attachable handle 414 may couple with removable counterweight 406 via connection with either facial attachment port 410 or apical attachment port 412. In a preferred embodiment, the design of removable counterweight 406 may be such that each edge of removable counterweight 406 may provide the user with a different function. For example, one edge may be sharp enough such that removable counterweight 406 may be engaged as an axe, while one edge may be curved such that removable counterweight 406 may be engaged as a pick. Additionally, depending upon whether attachable handle 414 is coupled to removable counterweight 406 via either facial attachment port 410 or apical attachment port 412, removable counterweight 406 may be engaged as a shovel. Furthermore, different connection points at varying angles or positioning may facilitate the creation of different tools or weapons, based on the orientation of removable counterweight 406 with respect to attachable handle 414. Once the tool is united, embodiments may comprise a shovel, an axe, an awl, pry, or a pick.

A helmet stabilization apparatus has been described. The foregoing description of the various exemplary embodiments of the invention has been presented for the purposes of illustration and disclosure. It is not intended to be exhaustive or to limit the invention to the precise form disclosed. Many modifications and variations are possible in light of the above teaching. It is intended that the scope of the invention not be limited by this detailed description, but by the claims and the equivalents to the claims.

What is claimed is:

1. A counterweight for a helmet comprising:

a shovel head having a first fastener and a second fastener;

wherein the shovel head has (i) a first curvature that mates with a first curvature of the helmet and (ii) a second curvature that mates with a second curvature of the helmet;

wherein the first fastener removably couples with the helmet in at least two different positions; and wherein the second fastener removably couples with an elongated member.

2. The counterweight of claim 1, wherein the second fastener is configured to removably attach to a second counterweight.

3. The counterweight of claim 1, wherein the elongated member is a handle.

4. The counterweight of claim 1, wherein the first fastener comprises a mechanical connector that removably engages a mechanical receiver disposed on the helmet.

5. The counterweight of claim 1, wherein the first fastener comprises a magnetic connector.

6. The counterweight of claim 1, wherein the first fastener comprises a hook and loop fastener disposed on a facial surface of the shovel head.

7. The counterweight of claim 1, wherein the second fastener comprises a mechanical connector disposed on a facial surface of the shovel head.

8. The counterweight of claim 1, wherein the second fastener comprises a mechanical connector disposed on an apical surface of the shovel head.

9. The counterweight of claim 1, wherein the first fastener comprises a plurality of mechanical connectors that removably attach to a plurality of mechanical receivers disposed on the helmet in at least two non-overlaping positions.

10. The counterweight of claim 1, wherein the first curvature of the shovel head is defined by a width of a facial surface of the shovel head.

11. The counterweight of claim 10, wherein the second curvature of the shovel head is defined by a height of the facial surface of the shovel head.

* * * * *